US005366215A

United States Patent [19]

Hastie et al.

[11] Patent Number: 5,366,215

[45] Date of Patent: Nov. 22, 1994

[54] DISABLING MECHANISM FOR SIGNATURE FEEDING APPARATUS

[75] Inventors: Ronald W. Hastie, Elk Grove Village; Lawrence D. Magee, Bolingbrook, both of Ill.

[73] Assignee: R. R. Donnelley & Sons Co., Lisle, Ill.

[21] Appl. No.: 159,435

[22] Filed: Nov. 29, 1993

[51] Int. Cl.[5] ..... B65H 3/08

[52] U.S. Cl. ..... 271/107; 271/100; 271/256; 74/567; 74/569

[58] Field of Search ..... 271/95, 99, 100, 101, 271/104, 106, 107, 11, 256, 257, 258; 74/567, 569

[56] References Cited

U.S. PATENT DOCUMENTS

| | | | |
|---|---|---|---|
| 3,608,893 | 9/1971 | McCain et al. | 271/256 |
| 4,544,149 | 10/1985 | Graef et al. | 271/107 |
| 5,014,979 | 5/1991 | Higgins et al. | 271/107 X |
| 5,029,836 | 7/1991 | Swaneck | 271/107 |
| 5,120,041 | 6/1992 | Schniter | 271/107 |
| 5,224,694 | 7/1993 | Magee | 271/107 X |

*Primary Examiner*—Cheryl L. Gastineau
*Assistant Examiner*—Boris Milef
*Attorney, Agent, or Firm*—Wood, Phillips, VanSanten, Hoffman & Ertel

[57] ABSTRACT

In order to avoid disruption of a stack of signatures, particularly when a cyclically operable signature feeding apparatus is temporarily disabled, the utilization of a unique disabling arrangement is contemplated. The signature feeding apparatus will generally include a driven rotary drum having a plurality of signature grippers disposed about the periphery thereof. The signature grippers are adapted to grip signatures seriatim from a signature supply hopper. A vacuum assembly is driven by a cam for shifting signatures seriatim from the signature supply hopper to the rotary drum for gripping by the signature grippers. The vacuum assembly includes a source of vacuum operatively associated with oscillating vacuum grippers. The signature feeding apparatus further includes a cam follower operatively associated with the vacuum assembly to control operation of the vacuum assembly responsive to engagement with a surface of the cam. With this arrangement, a mask is provided for masking the surface of the cam to disable operation of the vacuum assembly upon demand to disable operation of the signature feeding apparatus.

17 Claims, 2 Drawing Sheets

DISABLING MECHANISM FOR SIGNATURE FEEDING APPARATUS

FIELD OF THE INVENTION

The present invention is generally directed to a binding line device commonly known as a signature feeding apparatus, and, more particularly, a signature feeding apparatus in which the signature grippers and vacuum assembly are selectively disabled.

BACKGROUND OF THE INVENTION

Many large circulation periodicals are gathered on a binding line for stitching, trimming, bundling, and shipping. The binding line typically may include a plurality of signature feeding apparatus, each of which may have a driven rotary drum with a plurality of signature grippers disposed about the periphery thereof, and the signature grippers may be adapted to grip signatures seriatim as they are received from a signature supply means after they have been shifted therefrom to the rotary drum by cam driven vacuum means or other like components. Conventionally, the vacuum means will include oscillating vacuum grippers, together with a vacuum control valve.

In the case of saddle stitched books, a signature feeding apparatus will open the pages of a signature so that it may be dropped onto a saddle conveyor. The saddle conveyor then conveys that signature to the next signature feeding apparatus which may, in like manner, drop still another signature in straddle relation on top of the previously so distributed signature. In this manner, a book comprised of an entire collection of different signatures can be gathered for stitching on the saddle conveyor.

As will be appreciated by those skilled in the art, a book is simply a collection of signatures, regardless of the number of signatures and regardless of the manner in which the book is bound.

In more recent years, the books that are gathered on a binding line have been customized and/or personalized by utilizing a variety of different techniques. Typically, this involves computer control means whereby different combinations of signature feeding apparatus along a binding line are selectively disabled and enabled in order to be able to customize books according to demographics or the like. As a result, there has been a need to control operation of the various signature feeding apparatus on a binding line in an entirely satisfactory manner.

In the past, it will be appreciated that this has sometimes been accomplished in a variety of different ways, although almost always in a less than satisfactory manner. In this connection, experience has established that a desirable manner of shifting signatures seriatim from a signature supply hopper to a rotary drum is by means of oscillating vacuum grippers, and thus, one manner of disabling a signature feeding apparatus has been to shut off the vacuum by means of mounting an air cylinder on the vacuum valve which moves a sliding member across the vacuum inlet port leading to the oscillating vacuum grippers. While effective to disable the apparatus, this particular technique allows the oscillating vacuum grippers to continue impacting the stack of signatures in the supply hopper.

While the delivery of signatures is interrupted, the continual impacting of signatures is known to be detrimental. Specifically, it has been found that, in practice, it is sometimes the case that, after a given signature feeding apparatus has been disabled for a period of time, a resumption of the vacuum will not cause the next signature in the signature supply hopper to be delivered to the rotary drum in such a manner that it can be gripped as intended by the signature grippers thereon. If this fails to occur, a signature that is needed for a given book will not be delivered to the saddle conveyor as required.

As a result of this failure, the book that was being formed will be defective and must be discarded and reordered. It is, of course, now known how to avoid such a failure as disclosed in variously commonly owned patents and patent applications of R. R. Donnelley & Sons Company, but it would be highly desirable to not only eliminate the waste that otherwise is known to exist by reason of this problem by utilizing conventional disablement techniques but also to further enhance the desirability of utilizing disablement of a signature feeding apparatus in a manner that would eliminate or reduce wear such that, even if wear does eventually occur, it would not be critical to the actual operation of the equipment. In other words, the binding line would be rendered more efficient and profitable by eliminating this potential problem area.

The present invention is directed to overcoming one or more of the foregoing problems and achieving one or more of the resulting objectives.

SUMMARY OF THE INVENTION

It is a principal object of the present invention to provide an improved signature feeding apparatus which eliminates waste while enhancing efficiency. Further, it is an object of the invention to provide a signature feeding apparatus having an improved manner of selectively disabling the oscillating vacuum grippers and/or source of vacuum therefor. In addition, it is an object of the present invention to provide a mask for masking the surface of a cam to disable operation of a vacuum upon demand.

Accordingly, the present invention is directed to a cyclically operable signature feeding apparatus including a driven rotary drum having a plurality of signature grippers disposed about the periphery thereof. The signature grippers are adapted to grip signatures seriatim from a signature supply means. The signature feeding apparatus also includes vacuum means driven by cam means for shifting signatures seriatim from the signature supply means to the rotary drum for gripping by the signature grippers. The vacuum means includes a source of vacuum which is operatively associated with oscillating vacuum signature grippers. With this arrangement, the cyclically operable signature feeding apparatus will be seen to further utilize an entirely unique masking means as will be described in greater detail hereinafter.

More specifically, the cyclically operable signature feeding apparatus will also include a cam follower operatively associated with the vacuum means to control operation of the vacuum means responsive to engagement with a surface of the cam means, and the masking means may then selectively serve to mask the surface of the cam means to disable operation of the vacuum means upon demand to disable operation of the signature feeding apparatus.

In a highly preferred embodiment of the invention, the surface of the cam means will be understood to include a high dwell region and a low dwell region, both of which are normally in driving engagement with the cam follower. As for the means for masking the surface of the cam means, it selectively disables the source of vacuum and the oscillating vacuum grippers when the masking means is moved from a position exposing the low dwell region to a position masking the low dwell region.

Preferably, the cam follower includes a transfer arm having a cam follower surface normally in engagement with the surface of the cam means for imparting oscillating movement thereto. The transfer arm is advantageously biased by a spring normally urging the cam follower surface of the transfer arm toward engagement with the surface of the cam means about an axis remote from the axis of the cam means, and the transfer arm is also advantageously operatively associated with the oscillating vacuum grippers by a first oscillating movement imparting link and to the source of vacuum by a second oscillating movement imparting link. Further, the masking means preferably includes a cam mask mounted for pivotal movement between a first position out of the path of movement of the cam follower surface and a second position in the path of movement thereof.

In addition to the foregoing, the masking means is advantageously adapted to selectively disable the vacuum means when the high dwell region of the surface of the cam means is in engagement with the cam follower surface of the transfer arm, and the masking means is adapted to selectively enable the vacuum means when the high dwell region of the surface of the cam means is in engagement with the cam follower surface of the transfer arm.

With regard to the first oscillating movement imparting link, it is advantageously joined to the transfer arm at a point remote from the axis about which the cam follower surface moves. The first link is joined to the transfer arm generally in the region where the cam follower surface is in engagement with the surface of the cam means. As for the second oscillating movement imparting link, it is preferably joined to the transfer arm at a point generally intermediate the axis and the point where the first link is joined to the transfer arm.

Still additionally, the cam mask is advantageously mounted for pivotal movement about an axis coincident with an axis of the cam means. The cam mask is then preferably movable from a first position radially inwardly of the low dwell region to a second position radially outwardly thereof. Specifically, the second position is advantageously generally coextensive with the high dwell region of the surface of the cam means.

In the exemplary embodiment, the cam means will preferably include a first cam for the oscillating vacuum grippers as well as an axially spaced second cam for the source of vacuum. The cam follower then advantageously includes a first cam follower surface for the oscillating vacuum grippers and an axially spaced second cam follower surface for the source of vacuum. Additionally, the cam mask is preferably coaxially mounted between the first and second cams and driven by an air cylinder through a link between the air cylinder and the cam mask.

As a further aspect of the present invention, the source of vacuum includes a vacuum control valve which is always in an "off" position whenever the transfer arm is in a position where the cam follower surface is in a radial position corresponding to the radial position of the high dwell region of the surface of the cam means, no matter whether the cam follower surface is in direct engagement with the surface of the cam means or with the cam mask.

Other objects, advantages and features of the present invention will become apparent from a consideration of the following specification taken in conjunction with the accompanying drawings.

DETAILED DESCRIPTION OF THE PREFERRED EMBODIMENT

Figure 1:
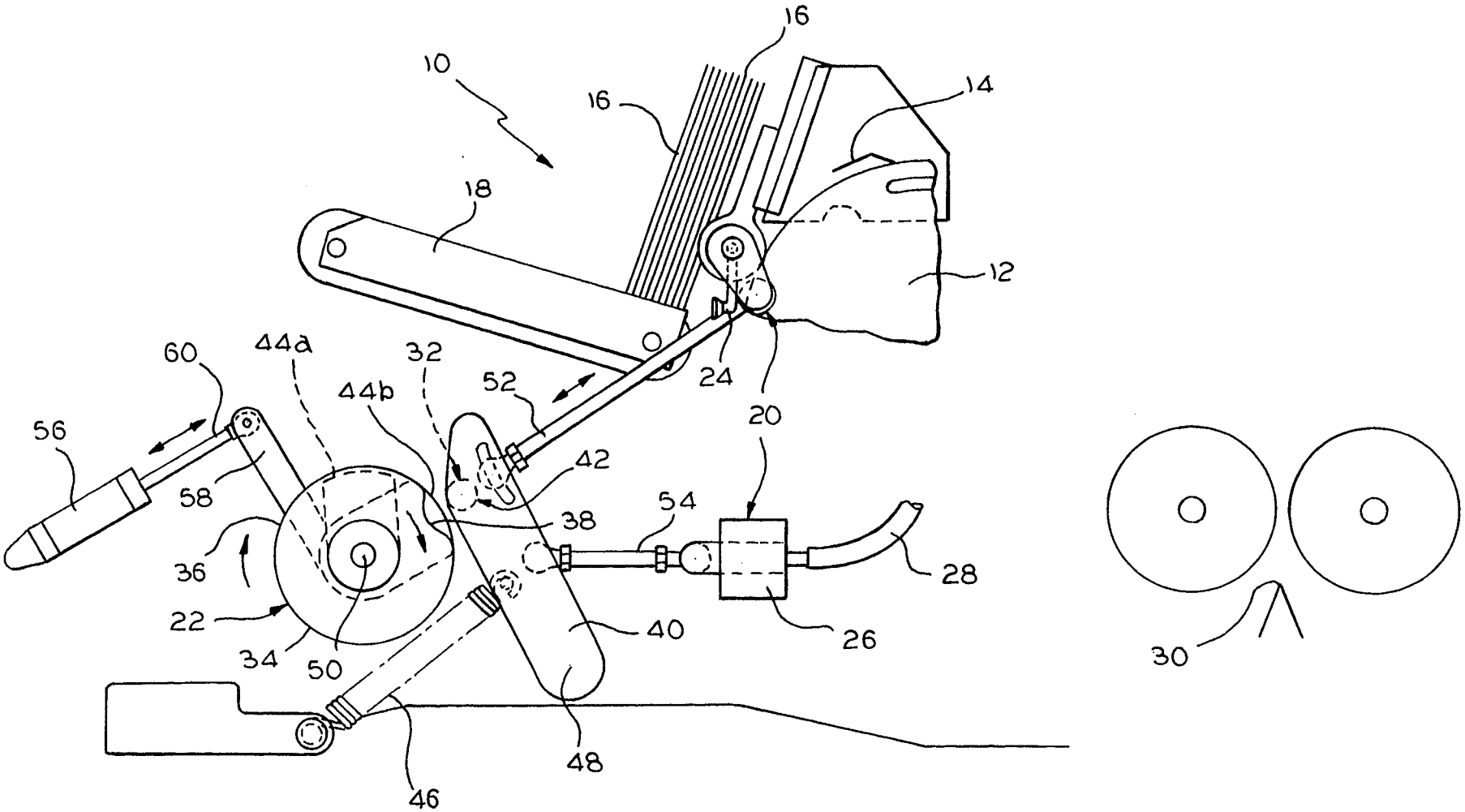
FIG. 1 is a schematic side elevational view of a signature feeding apparatus according to the invention.

In the illustrations given, and with reference first to FIG. 1, the reference numeral 10 designates generally a cyclically operable signature feeding apparatus including a driven rotary drum 12 having a plurality of signature grippers 14 disposed about the periphery thereof. The signature grippers 14 are adapted to grip signatures 16 seriatim from a signature supply means 18. The signature feeding apparatus 10 also includes vacuum means generally designated 20 driven by cam means generally designated 22 for shifting signatures 16 seriatim from the signature supply means 18 to the rotary drum 12 for gripping by the signature grippers 14. The vacuum means 20 includes oscillating suction grippers 24 together with a vacuum control valve 26 in communication with a source of vacuum through a vacuum line 28. With this arrangement, the signature feeding apparatus 10 will be understood as operable to move signatures such as 16 in a cyclical manner from a source such as the signature supply means 18 to a gathering chain (shown schematically) 30.

Figure 2:
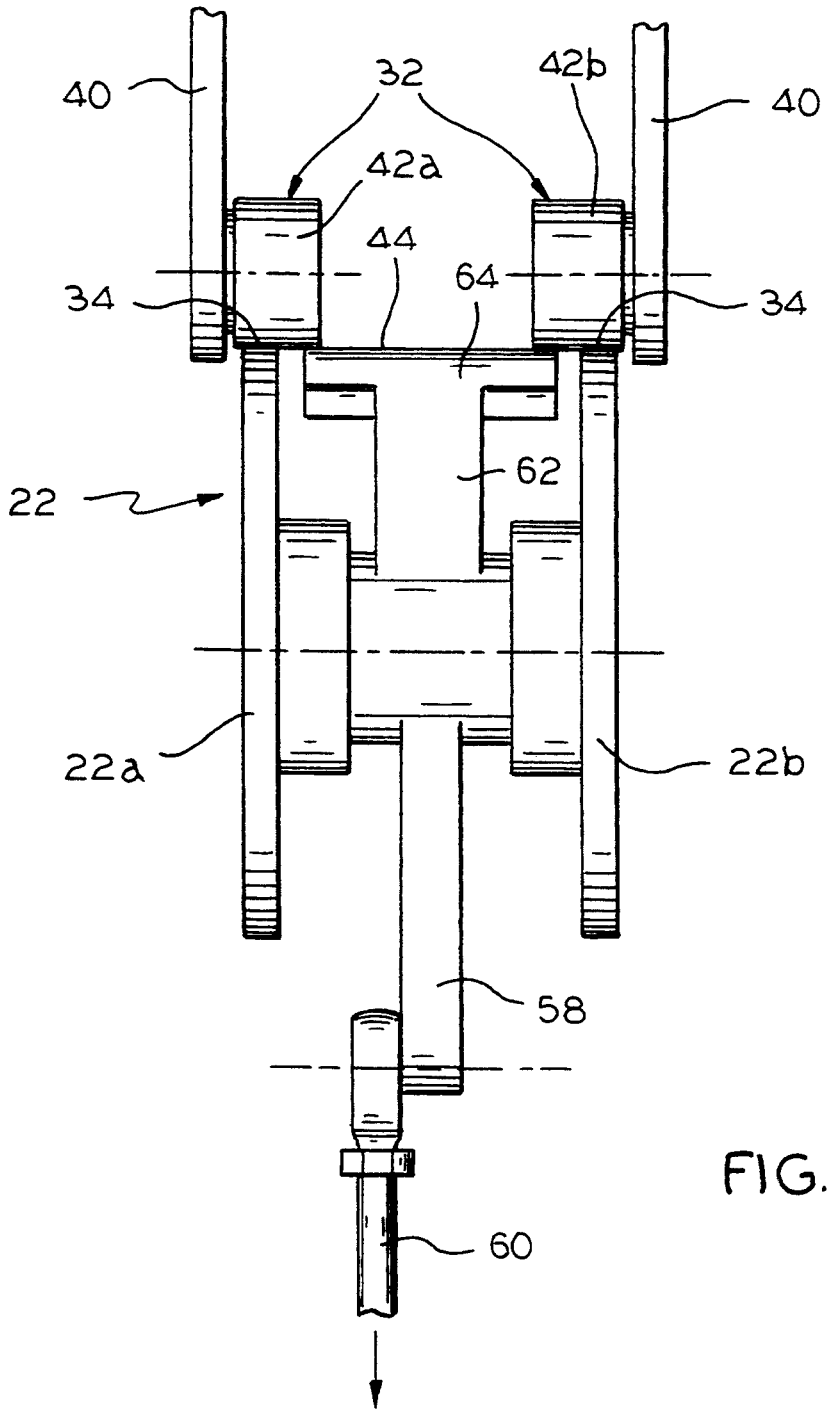
FIG. 2 is a schematic front elevational view of a portion of the signature feeding apparatus of FIG. 1.

With this understanding of the signature feeding apparatus 10, as generally known in the art, the present invention can be understood by referring to both FIG. 1 and FIG. 2. The signature feeding apparatus 10 will be seen to include a cam follower 32 operatively associated with the vacuum means 20 to control operation of the vacuum means 20 responsive to engagement with a surface 34 of the cam means 22. Still additionally, the signature feeding apparatus 10 includes means for masking the surface 34 of the cam means 22 to disable operation of the vacuum means 20 upon demand to disable operation of the signature feeding apparatus 10.

As shown, the surface 34 of the cam means 22 includes a high dwell region 36 and a low dwell region 38 where both are normally in driving engagement with the cam follower 32. The cam follower 32 will be seen to include a transfer arm 40 which has a cam follower surface 42 that is normally in engagement with the surface 34 of the cam means 22 to thereby impart oscillating movement thereto. With this arrangement, the masking means can selectively disable the source of vacuum or vacuum means 20 and the oscillating vacuum grippers 24 when the masking means is moved according to the invention.

More specifically, the selective disablement is accomplished when the masking means is moved from a position exposing the low dwell region 38 to a position masking the low dwell region 38. The masking means will be seen to include a cam mask 44 mounted for pivotal movement between a first position **44*a* out of the path of movement of the cam follower surface 32 and a second position 44b in the path of movement thereof. As a result, the cam mask 44 can be moved into the second position 44b, i.e., the path of normal movement of the cam follower 32, whenever it is desired to disable the vacuum means 20**.

Preferably, the cam mask 44 is adapted to selectively disable the vacuum means 20 when the high dwell region 36 of the surface 34 of the cam means 22 is in engagement with the cam follower surface 32 of the transfer arm 40. This means that the movement of the cam mask 44 from the first position 44a to the second position 44b advantageously takes place during the period of time that the cam follower surface 42 is in engagement with the high dwell region 36 of the surface 34 of the cam means 22. Concomitantly, the cam mask 44 is adapted to selectively enable the vacuum means 20 when the high dwell region 36 of the surface 34 of the cam means 22 is in engagement with the cam follower surface 42 of the transfer arm 40.

As shown in FIG. 1, the transfer arm 40 is biased by a spring 46 normally urging the cam follower surface 42 of the cam follower 32 toward engagement with the surface 34 of the cam means 22 about an axis 48 remote from an axis 50 of the cam means 22. The transfer arm 40 is operatively associated with the oscillating vacuum grippers 24 by a first oscillating movement imparting link 52 and to the source of vacuum through the vacuum control valve 26 and the supply line 28 by a second oscillating movement imparting link 54. As will be appreciated, the first and second oscillating movement imparting links 52 and 54 may be secured to the transfer arm 40 and the oscillating vacuum grippers 24 and vacuum control valve 26 in any conventional manner that may also accommodate adjustability thereof.

Referring specifically to FIG. 1, the first oscillating movement imparting link 52 will be understood as being joined to the transfer arm 40 at a point which is remote from the axis 48. In this regard, the first link 52 will be seen to be joined to the transfer arm 40 generally in the region where the cam follower surface 42 is in engagement with the surface 34 of the cam means 22. Further, the second oscillating movement imparting link 54 will be understood as being joined to the transfer arm 40 at a point generally intermediate the axis 48 and the point where the first link 52 is joined to the transfer arm 40.

Referring to both of FIGS. 1 and 2, the cam mask 44 is mounted for pivotal movement about an axis coincident with the axis 50 of the cam means 22. The cam mask 44 is, more specifically, movable about the axis 50 from the first position 44a which is angularly spaced from the cam follower 32 to the second position 44b which is adjacent the cam follower 32, substantially as shown in solid lines in FIG. 1. As will be appreciated from FIG. 1, the cam mask 44 is generally coextensive with the high dwell region 36 of the surface 34 of the cam means 22.

As previously mentioned, the source of vacuum includes the vacuum control valve 26 which is always in an "off" position whenever the transfer arm 40 is located such that the cam follower surface 42 is in a radial position corresponding to the radial position of the high dwell region 36 of the surface 34 of the cam means 22 no matter whether the cam follower surface 42 is in direct engagement with the surface 34 of the cam means 22 or with the cam mask 44.

Still additionally, and referring to FIG. 2, the cam means 22 preferably includes a first cam 22a for the oscillating vacuum grippers 24 and an axially spaced second cam 22b for the source of vacuum controlled through the vacuum control valve 26 and the supply line 28 in which case the cam follower 32 includes a first cam follower surface 42a for the oscillating vacuum grippers 24 and an axially spaced second cam follower surface 42b for the source of vacuum controlled through the vacuum control valve 26 and the supply line 28.

As specifically shown in FIGS. 1 and 2, the cam mask 44 is coaxially mounted between the first and second cams 22a and 22b and is driven by an air cylinder 56 through a link 58 extending between the connecting rod 60 of the air cylinder piston and the cam mask 44.

In the embodiment illustrated in FIG. 2, the cam mask 44 is generally T-shaped and includes a radially extending central arm 62 and an axially extending circumferential segment 64. The circumferential segment 64 extends a sufficient distance toward each of the first and second cams 22a and 22b so as to allow the cam follower surfaces 42a and 42b to make contact with the cam mask 44. Of course, the contact between the cam mask 44 and the cam follower surfaces 42a and 42b will be effective when the low dwell regions of the first and second cams 22a and 22b pass angularly by the cam follower surfaces 42a and 42b.

While in the foregoing there has been set forth a preferred embodiment of the invention, it will be appreciated that the details herein given may be varied those skilled in the art without depart from the true spirit and scope of the appended claims.

What is claimed is:

1. In a cyclically operable signature feeding apparatus including a driven rotary drum having a plurality of signature grippers disposed about the periphery thereof, said signature grippers being adapted to grip signatures seriatim from a signature supply means, vacuum means driven by cam means for shifting signatures seriatim from said signature supply means to said rotary drum for gripping by said signature grippers, said vacuum means including a source of vacuum operatively associated with oscillating vacuum grippers, the improvement comprising:

a cam follower operatively associated with said vacuum means to control operation of said vacuum means responsive to engagement with a surface of said cam means; and means for masking said surface of said cam means to disable operation of said vacuum means upon demand to disable operation of said signature feeding apparatus wherein said surface of said cam means includes a high dwell region and a low dwell region both of which are normally in driving engagement with said cam follower, said masking means selectively disabling said source of vacuum and said oscillating vacuum grippers when said masking means is moved from a position exposing said low dwell region to a position masking said low dwell region.

2. The signature feeding apparatus of claim 1 wherein said cam follower includes a transfer arm having a cam follower surface normally in engagement with said surface of said cam means for imparting oscillating movement thereto, said transfer arm being biased by a spring normally urging said cam follower surface of said transfer arm toward engagement with said surface of said cam means about an axis remote from an axis of said cam means.

3. The signature feeding apparatus of claim 1 wherein said cam follower includes a transfer arm having a cam follower surface normally in engagement with said surface of said cam means for imparting oscillating movement thereto, and said transfer arm being operatively associated with said oscillating vacuum grippers by a first oscillating movement imparting link and to said source of vacuum by a second oscillating movement imparting link.

4. The signature feeding apparatus of claim 1 wherein said cam follower includes a transfer arm having a cam follower surface normally in engagement with said surface of said cam means for imparting oscillating movement thereto, said masking means including a cam mask mounted for pivotal movement between a first position out of the path of movement of said cam follower surface and a second position in the path of movement thereof.

5. In a cyclically operable signature feeding apparatus including a driven rotary drum having a plurality of signature grippers disposed about the periphery thereof, said signature grippers being adapted to grip signatures seriatim from a signature supply means, vacuum means driven by cam means for shifting signatures seriatim from said signature supply means to said rotary drum for gripping by said signature grippers, said vacuum means including a source of vacuum operatively associated with oscillating vacuum grippers, the improvement comprising:

a cam follower operatively associated with said vacuum means to control operation of said vacuum means responsive to engagement with a surface of said cam means, said surface of said cam means including a high dwell region and a low dwell region where both of said regions are normally in driving engagement with said cam follower, said cam follower including a transfer arm having a cam follower surface normally in engagement with said surface of said cam means for imparting oscillating movement thereto; and means for masking said surface of said cam means to disable operation of said vacuum means upon demand to disable operation of said signature feeding apparatus by selectively disabling said source of vacuum and said oscillating vacuum grippers when said masking means is moved from a position exposing said low dwell region to a position masking said low dwell region.

6. The signature feeding apparatus of claim 5 wherein said transfer arm is biased by a spring normally urging said cam follower surface of said transfer arm toward engagement with said surface of said cam means about an axis remote from an axis of said cam means.

7. The signature feeding apparatus of claim 5 wherein said transfer arm is operatively associated with said oscillating vacuum grippers by a first oscillating movement imparting link and to said source of vacuum by a second oscillating movement imparting link.

8. The signature feeding apparatus of claim 5 wherein said masking means includes a cam mask mounted for pivotal movement between a first position out of the path of movement of said cam follower surface and a second position in the path of movement thereof.

9. The signature feeding apparatus of claim 5 wherein said masking means is adapted to selectively disable said vacuum means when said high dwell region of said surface of said cam means is in engagement with said cam follower surface of said transfer arm.

10. The signature feeding apparatus of claim 5 wherein said masking means is adapted to selectively enable said vacuum means when said high dwell region of said surface of said cam means is in engagement with said cam follower surface of said transfer arm.

11. In a cyclically operable signature feeding apparatus including a driven rotary drum having a plurality of signature grippers disposed about the periphery thereof, said signature grippers being adapted to grip signatures seriatim from a signature supply means, vacuum means driven by cam means for shifting signatures seriatim from said signature supply means to said rotary drum for gripping by said signature grippers, said vacuum means including a source of vacuum operatively associated with oscillating vacuum grippers, the improvement comprising:

a cam follower operatively associated with said vacuum means to control operation of said vacuum means responsive to engagement with a surface of said cam means, said surface of said cam means including a high dwell region and a low dwell region where both of said regions are normally in driving engagement with said cam follower, said cam follower including a transfer arm having a cam follower surface normally in engagement with said surface of said cam means for imparting oscillating movement thereto; and means for masking said surface of said cam means to disable operation of said vacuum means upon demand to disable operation of said signature feeding apparatus by selectively disabling said source of vacuum and said oscillating vacuum grippers when said masking means is moved from a position exposing said low dwell region to a position masking said low dwell region, said masking means including a cam mask mounted for pivotal movement between a first position out of the path of movement of said cam follower surface and a second position in the path of movement thereof, said cam mask being adapted to selectively disable said vacuum means when said high dwell region of said surface of said cam means is in engagement with said cam follower surface of said transfer arm and to selectively enable said vacuum means when said high dwell region of said surface of said cam means is in engagement with said cam follower surface of said transfer arm.

12. The signature feeding apparatus of claim 11 wherein said transfer arm is biased by a spring normally urging said cam follower surface of said transfer arm toward engagement with said surface of said cam means about an axis remote from an axis of said cam means.

13. The signature feeding apparatus of claim 12 wherein said transfer arm is operatively associated with said oscillating vacuum grippers by a first oscillating movement imparting link and to said source of vacuum by a second oscillating movement imparting link.

14. The signature feeding apparatus of claim 13 wherein said first link is joined to said transfer arm at a point remote from said transfer arm axis, said first link being joined to said transfer arm generally in the region where said cam follower surface is in engagement with said surface of said cam means, said second link being joined to said transfer arm at a point generally intermediate said transfer arm axis and the point where said first link is joined to said transfer arm.

15. The signature feeding apparatus of claim 11 wherein said cam mask is mounted for pivotal movement about an axis coincident with an axis of said cam means, said cam mask being movable from a first position angularly spaced from said cam follower to a second position adjacent said cam follower, said cam mask being generally radially coextensive with said high dwell region of said surface of said cam means.

16. The signature feeding apparatus of claim 11 wherein said source of vacuum includes a vacuum control valve which is always in an "off" position whenever said transfer arm is in a position where said cam follower surface is in a radial position corresponding to the radial position of said high dwell region of said surface of said cam means no matter whether said cam follower surface is in direct engagement with said surface of said cam means or with said cam mask.

17. The signature feeding apparatus of claim 11 wherein said cam means includes a first cam for said oscillating vacuum grippers and an axially spaced second cam for said source of vacuum, said cam follower including a first cam follower surface for said oscillating vacuum grippers and an axially spaced second cam follower surface for said source of vacuum, and said cam mask being coaxially mounted between said first and second cams and driven by an air cylinder through a link between said air cylinder and said cam mask.

* * * * *